US007254846B2

(12) United States Patent
Kim

(10) Patent No.: US 7,254,846 B2
(45) Date of Patent: Aug. 14, 2007

(54) TOILET SEAT TILTING DEVICE

(75) Inventor: Mi Ae Kim, Los Angeles, CA (US)

(73) Assignee: Young Han Joo, Los Angeles, CA (US)

( * ) Notice: Subject to any disclaimer, the term of this patent is extended or adjusted under 35 U.S.C. 154(b) by 15 days.

(21) Appl. No.: 10/838,883

(22) Filed: May 4, 2004

(65) Prior Publication Data

US 2005/0246827 A1 Nov. 10, 2005

(51) Int. Cl.
*A47K 13/10* (2006.01)

(52) U.S. Cl. ..... 4/246.3

(58) Field of Classification Search ..... 4/246.3, 4/246.4, 246.5

See application file for complete search history.

(56) References Cited

U.S. PATENT DOCUMENTS

| | | | | | |
|---|---|---|---|---|---|
| 1,099,801 | A | | 6/1914 | Hirsch | 4/246.4 |
| 1,276,472 | A | * | 8/1918 | Zeen | 4/246.4 |
| 1,333,747 | A | | 3/1920 | Yoshinaga | 4/246.1 |
| 1,877,083 | A | | 9/1932 | Thrasher | 4/246.5 |
| 2,136,684 | A | * | 11/1938 | Greavu | 4/246.5 |
| 2,723,400 | A | | 11/1955 | Wilson | 4/246.1 |
| 2,954,565 | A | * | 10/1960 | Miller | 4/246.3 |
| 3,055,016 | A | * | 9/1962 | Kemp | 4/246.5 |
| 3,528,075 | A | | 9/1970 | Leon | 4/246.5 |
| 4,426,743 | A | | 1/1984 | Seabrooke | 4/246.3 |
| 4,470,161 | A | | 9/1984 | Seabrooke | 4/246.3 |
| 4,534,073 | A | | 8/1985 | Smith | 4/246.4 |
| 4,592,097 | A | | 6/1986 | Zimmerman | 4/246.4 |
| 5,103,506 | A | | 4/1992 | Munford et al. | 4/246.4 |
| 5,323,496 | A | | 6/1994 | Blair | 4/246.3 |
| 5,327,589 | A | | 7/1994 | Rice | 4/246.2 |
| 5,448,782 | A | | 9/1995 | Ratajac | 4/246.5 |
| 5,594,958 | A | | 1/1997 | Nguyen | 4/246.5 |
| 5,875,498 | A | | 3/1999 | Joseph | 4/246.5 |
| 6,112,335 | A | | 9/2000 | Gaston | 4/261.1 |
| 6,393,623 | B1 | | 5/2002 | Strickland, Jr. | 4/246.3 |
| 6,470,503 | B1 | | 10/2002 | Holmes | 4/246.1 |

* cited by examiner

*Primary Examiner*—Robert M. Fetsuga
(74) *Attorney, Agent, or Firm*—John K. Park; Park Law Firm

(57) ABSTRACT

A toilet seat tilting device includes a base, a seat tilting member, a cam member, a first lever, a second lever and a connecting rod. The base includes a cam bracket and a lever bracket. The cam member is pivotally attached to the cam bracket and includes a first arm and a second arm. The first lever and the second lever are pivotally attached to the lever bracket and include a pedal and an actuating arm. The connecting rod connects the cam member and the seat tilting member. When the first pedal is pressed the first actuating arm pivots the first arm of the cam member upward and the seat is tilted upward until the seat is fully pivoted upward, and the seat remains fully pivoted upward. The second pedal similarly operates to tilt the seat downward.

15 Claims, 5 Drawing Sheets

TOILET SEAT TILTING DEVICE

BACKGROUND OF THE INVENTION

The present invention relates to a toilet seat tilting device. More particularly, this invention relates to a hands-off toilet tilting device that can tilt up or down the toilet seat with simple and reliable mechanism.

There are many toilet seat tilting devices by prior art.

U.S. Pat. No. 1,099,801 to N. Hirsch discloses a combination of rods and hinges to close and open the toilet seat.

U.S. Pat. No. 1,333,747 to Yoshinaga discloses use of a foot lever to manually open and close the toilet seat.

U.S. Pat. No. 1,877,083 to L. C. Thrasher and U.S. Pat. No. 5,594,958 to L. N. Nguyen disclose use of two foot levers.

None of the prior art devices were satisfactory in the aspects of ease of installation, adjustability to different size of toilets, smooth operability, and simple mechanism.

SUMMARY OF THE INVENTION

The present invention contrives to solve the disadvantages of the prior art.

An objective of the invention is to provide a toilet seat tilting device that provide smooth and effortless operation of opening or closing toilet seat.

Another objective of the invention is to provide a toilet seat tilting device that can be installed without modifying existing toilets.

Still another objective of the invention is to provide a toilet seat tilting device that can be adjusted to fit various size of toilets.

Still another objective of the invention is to provide a toilet seat tilting device that is easy to install to existing toilets.

To achieve the above objectives, the present invention provides a toilet seat tilting device for tilting up and down a seat of a toilet. The device includes a base, a seat tilting member, a cam member, a first lever, a second lever and a connecting rod.

The base includes a cam bracket and a lever bracket.

The cam member is pivotally attached to the cam bracket and includes a cam pivot point, around which the cam member is pivoted, a first arm, and a second arm. The first arm and the second arm are positioned opposite with respect to the cam pivot point.

The first lever is pivotally attached to the lever bracket and includes a first lever pivot point, around which the first lever is pivoted, a first pedal, and a first actuating arm. The first pedal and the first actuating arm are positioned opposite with respect to the first lever pivot point.

The second lever is pivotally attached to the lever bracket and includes a second lever pivot point, around which the second lever is pivoted, a second pedal, and a second actuating arm. The second pedal and the second actuating arm are positioned opposite with respect to the second lever pivot point.

The connecting rod connects the cam member and the seat tilting member.

When the first pedal is pressed the first actuating arm pivots the first arm of the cam member upward and the seat of the toilet is tilted upward until the seat is fully pivoted upward, and the seat remains fully pivoted upward.

When the second pedal is pressed the second actuating arm pivots the second arm of the cam member upward and the seat of the toilet is tilted downward until the seat is fully pivoted downward, and the seat remains fully pivoted downward.

The seat tilting member includes a seat bracket, and a seat piece pivotally attached to the seat bracket. The seat piece includes a seat pivot point, around which the seat piece is pivoted, a first seat arm that is connected to the connecting rod, a second seat arm that supports the seat of the toilet. The first seat arm and the second seat arm are positioned opposite with respect to the seat pivot point.

The seat piece further includes a seat holder attached to the second seat arm. The seat holder includes an upper holding member and a lower holding member. The seat is supported between the upper holding member and the lower holding member.

Preferably, the upper holding member is a rod, and the lower holding member is a plate.

The connecting rod is pivotally attached to the second arm of the cam member and to the first seat arm of the seat tilting member.

The first actuating arm of the first lever is made of wire and includes a first lever body and a first end portion that is bent from the first lever body and contacts the first arm of the cam member. The second actuating arm of the second lever is made of wire and includes a second lever body and a second end portion that is bent from the second lever body and contacts the second arm of the cam member.

The base is fixed to the toilet. The toilet seat tilting device further includes an install bracket that fixes the base to the toilet. The install bracket has a thorough hole, through which a bolt provided on the toilet passes through.

The length of the connecting rod is adjustable. The connecting rod includes a rod body and one or more rod end piece. The rod end piece includes an end thread portion that engages with a rod thread portion that is provided on the rod body.

The toilet seat tilting device further includes a support column that is fixed to the base and supports the seat tilting member. The length of the support column is adjustable. The support column includes a column body and one or more column end piece. The column end piece includes an end thread portion that engages with a column thread portion that is provided on the column body.

The advantages of the present invention are: (1) a simple and smoothly operating, toilet seat tilting device is provided; (2) the device does not need modification of a toilet to install; (3) the device is adaptable to various toilets having different sizes; (4) the device can be installed at either side of the toilte.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
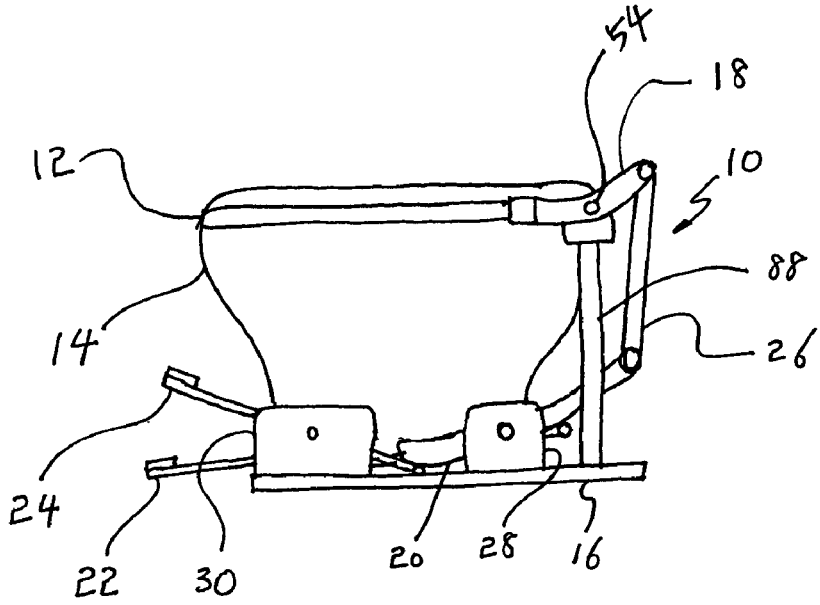
FIG. 1 is an elevation view of toilet seat tilting device of the present invention.
Figure 2:
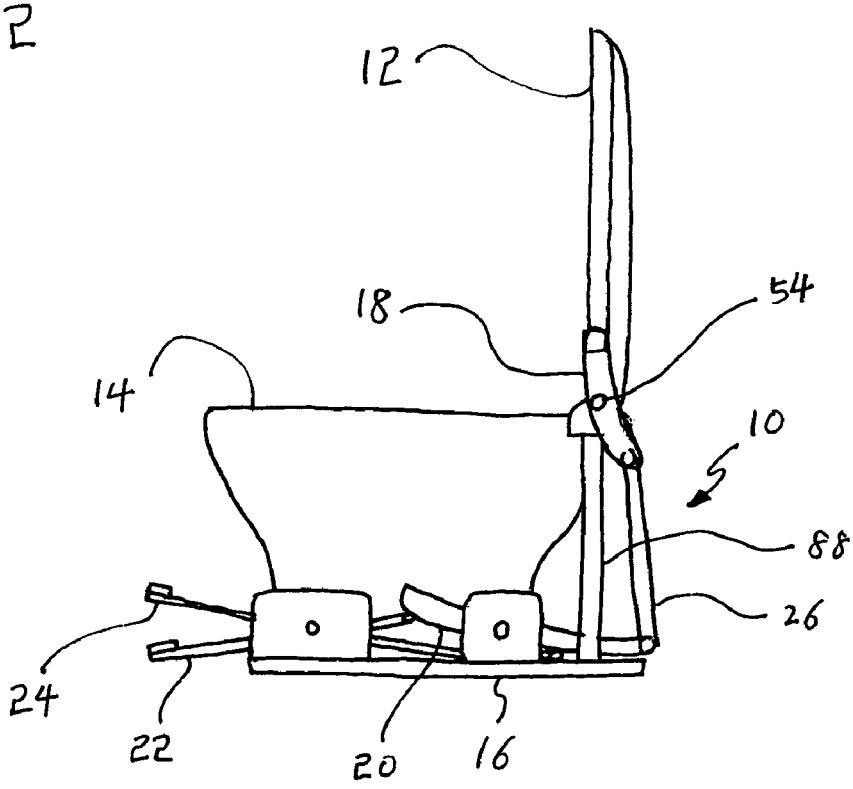
FIG. 2 is a view similar to FIG. 1 but shows the seat is tilted up.

FIGS. 1 and 2 show a toilet seat tilting device 10 for tilting up and down a seat 12 of a toilet 14. The device 10 includes a base 16, a seat tilting member 18, a cam member 20, a first lever 22, a second lever 24 and a connecting rod 26. FIG. 1 shows that the seat 12 is tilted down, and FIG. 2 shows that the seat 12 is tilted up.

The base 16 includes a cam bracket 28 and a lever bracket 30. The connecting rod 26 connects the cam member 20 and the seat tilting member 18.

Figure 3:
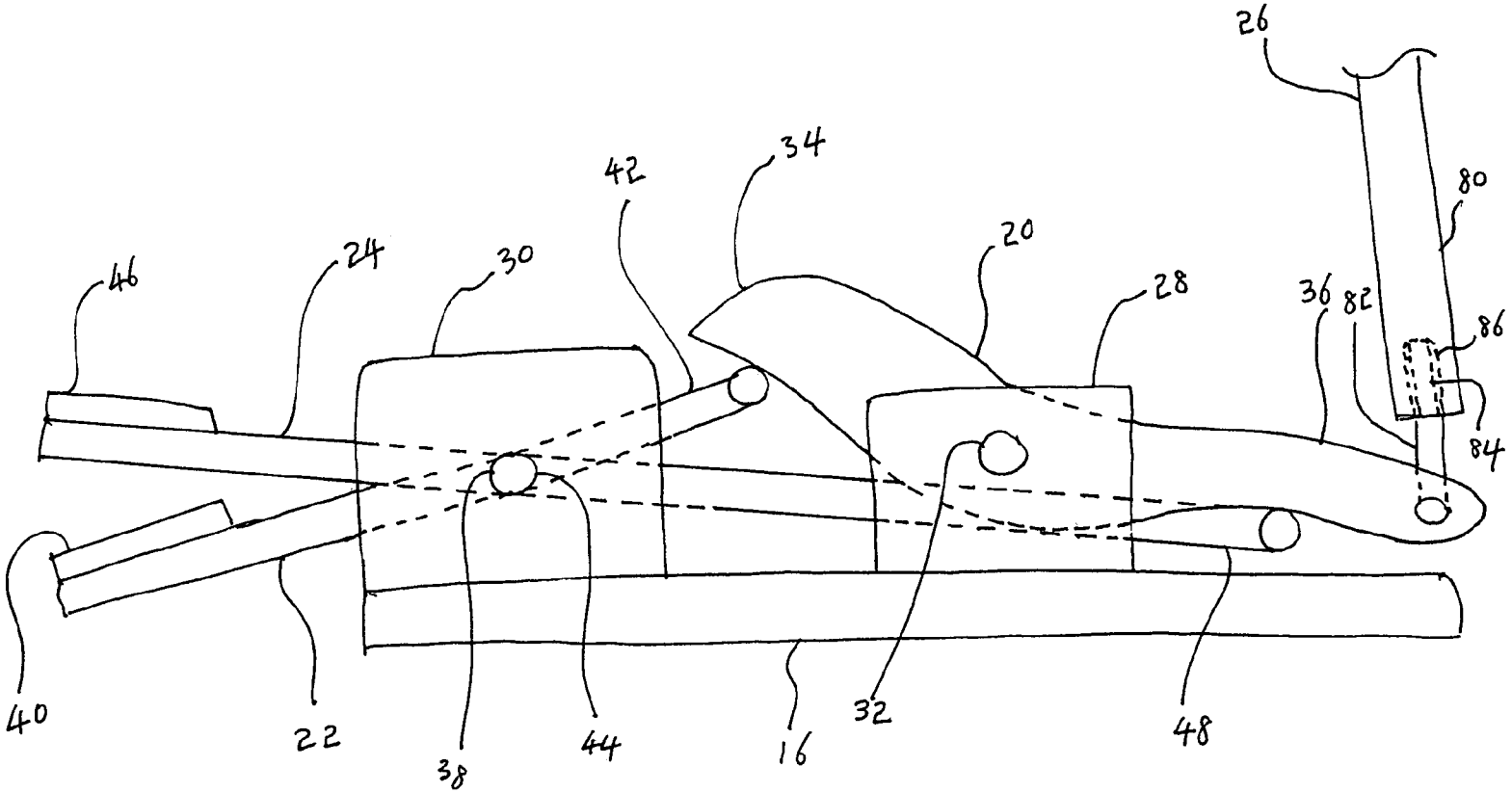
FIG. 3 is a partial elevation view of the toilet seat tilting device.

Referring to FIG. 3, the cam member 20 is pivotally attached to the cam bracket 28 and includes a cam pivot point 32, around which the cam member 20 is pivoted, a first arm 34, and a second arm 36. The first arm 34 and the second arm 36 are positioned opposite with respect to the cam pivot point 32.

The first lever 22 is pivotally attached to the lever bracket 30 and includes a first lever pivot point 38, around which the first lever 22 is pivoted, a first pedal 40, and a first actuating arm 42. The first pedal 40 and the first actuating arm 42 are positioned opposite with respect to the first lever pivot point 38.

The second lever 24 is pivotally attached to the lever bracket 30 and includes a second lever pivot point 44, around which the second lever 24 is pivoted, a second pedal 46, and a second actuating arm 48. The second pedal 46 and the second actuating arm 48 are positioned opposite with respect to the second lever pivot point 44.

When the first pedal 40 is pressed the first actuating arm 42 pivots the first arm 34 of the cam member 20 upward and the seat 12 of the toilet 14 is tilted upward until the seat is fully pivoted upward, and the seat 12 remains fully pivoted upward as shown in FIG. 2.

When the second pedal 46 is pressed the second actuating arm 48 pivots the second arm 36 of the cam member 20 upward and the seat 12 of the toilet 14 is tilted downward until the seat 12 is fully pivoted downward, and the seat 12 remains fully pivoted downward as shown in FIG. 1.

Figure 4:
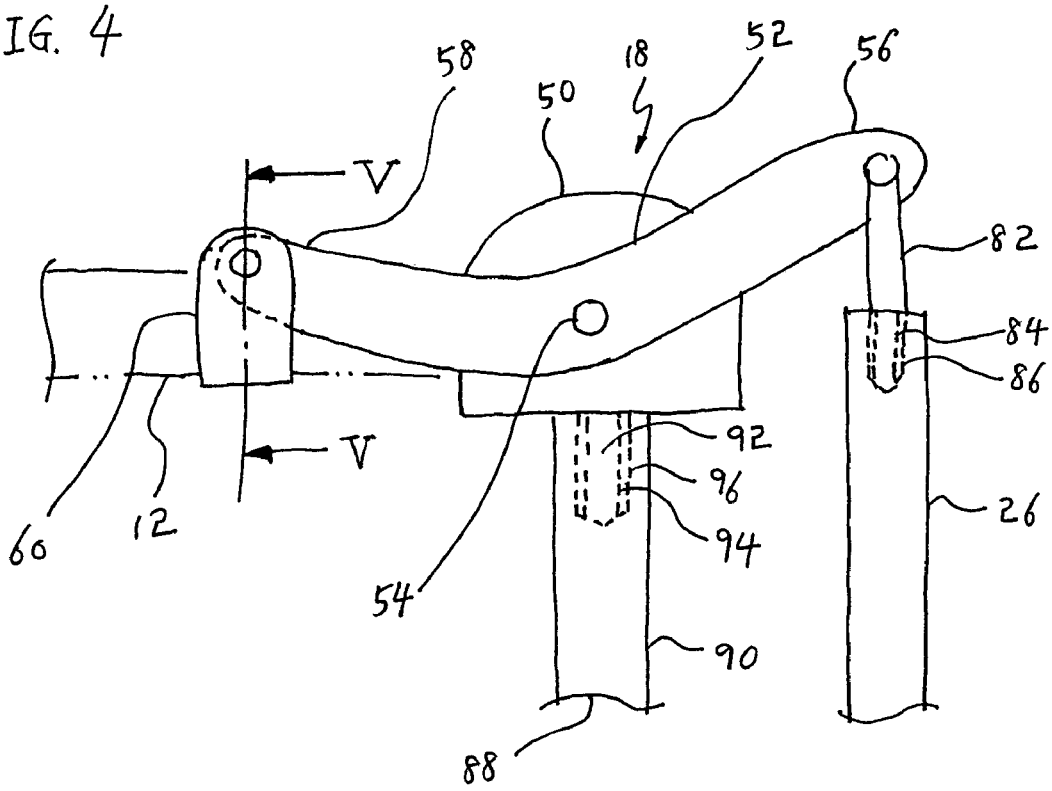
FIG. 4 is an elevation view of a seat tilting member.

Referring to FIG. 4, the seat tilting member 18 includes a seat bracket 50, and a seat piece 52 pivotally attached to the seat bracket 50. The seat piece 52 includes a seat pivot point 54, around which the seat piece 52 is pivoted, a first seat arm 56 that is connected to the connecting rod 26, a second seat arm 58 that supports the seat 12 of the toilet 14. The first seat arm 56 and the second seat arm 58 are positioned opposite with respect to the seat pivot point 54.

Figure 5:
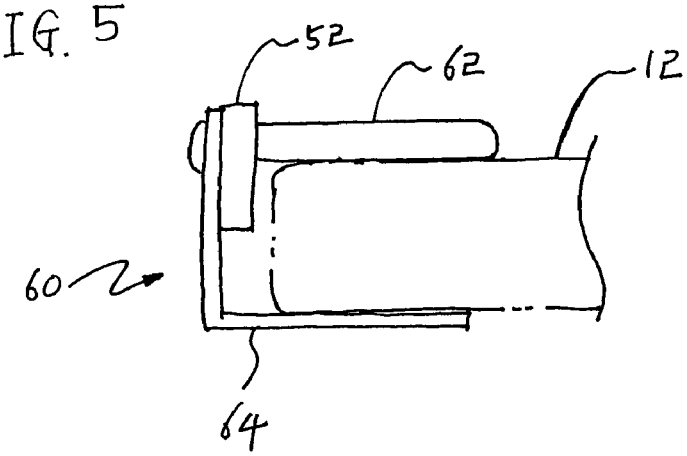
FIG. 5 is a sectional view taken along the line V—V in FIG. 4.

The seat piece 52 further includes a seat holder 60 attached to the second seat arm 58. Referring to FIG. 5, the seat holder 60 includes an upper holding member 62 and a lower holding member 64. The seat 12 is supported between the upper holding member 62 and the lower holding member 64. In the figure, the upper holding member 62 is a rod, and the lower holding member is a plate 64. In this way, the seat tilting member 18 can be installed to hold the seat 12 without modification of the seat 12 and without any fastener that is fixed to the seat 12.

Figure 7:
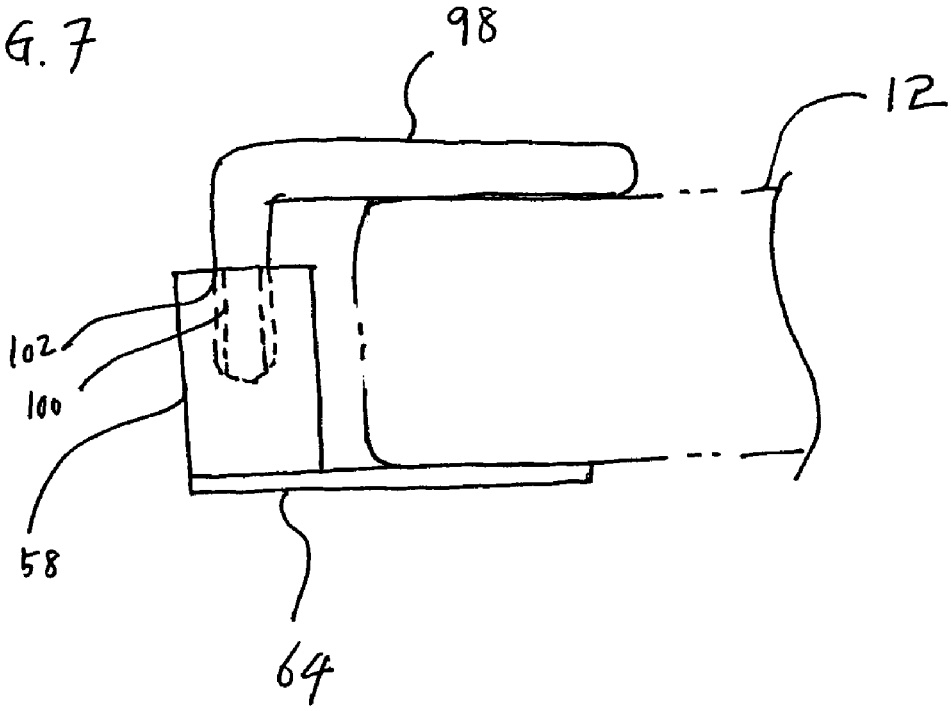
FIG. 7 is a view similar to FIG. 5 showing an adjustable holding member.

Referring to FIG. 7 shows an adjustable upper holding member 98. The upper holding member 98 has a hold thread portion 100 that engages with a seat thread portion 102 that is provided in the second seat arm 58. By rotation of the upper holding member 98, the distance between the upper holding member 98 and the lower holding member 64 is adjustable. In this way, the seat holder 60 can securely hold seats having different thickness.

Referring back to FIGS. 3 and 4, the connecting rod 26 is pivotally attached to the second arm 36 of the cam member 20 and to the first seat arm 56 of the seat tilting member 18.

Referring back to FIGS. 1 and 2, the seat pivot point 54 is positioned substantially to be the same line with the axis of hinges for seat 12 of the toilet 14. This positioning may be facilitated by an adjustable support column 88, and positioning of an install bracket 74 on the base 16. The support column 88 and the install bracket 74 are explained later.

In this way, the toilet seat tilting device 10 does not need a spring or other power assisting means in tilting up and down the seat 12. Also, no stopper or frictional element is needed since the operation of the cam member 20 and the seat tilting member 18 are balanced, and thus the seat 12 keeps its position either tilted up or tilted down by itself.

Figure 6:
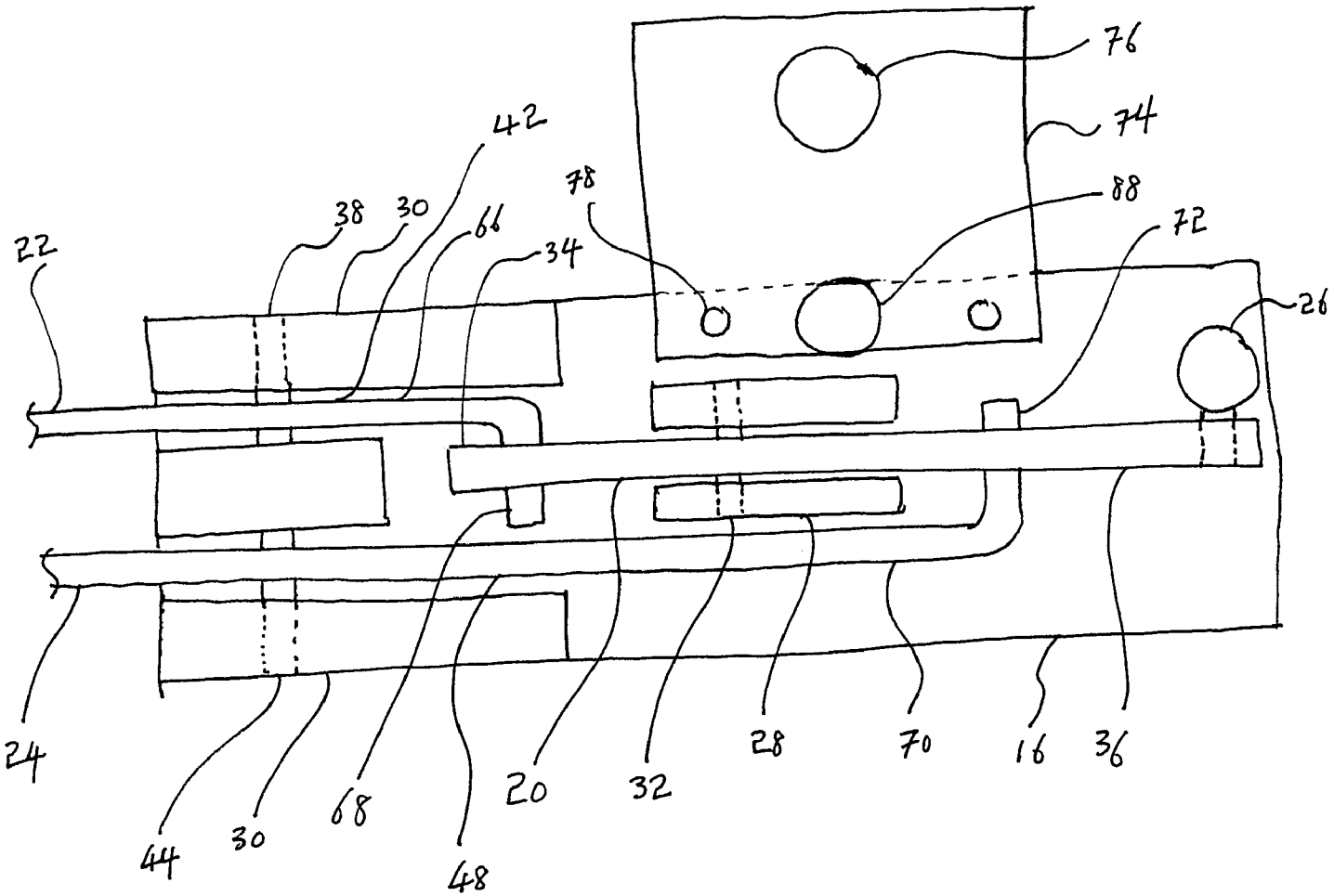
FIG. 6 is a partial plan view of the seat tilting device.

Referring to FIG. 6, the first actuating arm 42 of the first lever 22 is made of wire and includes a first lever body 66 and a first end portion 68 that is bent from the first lever body 66 and contacts the first arm 34 of the cam member 20. The second actuating arm 48 of the second lever 24 is made of wire and includes a second lever body 70 and a second end portion 72 that is bent from the second lever body 70 and contacts the second arm 36 of the cam member 20.

The base 16 is fixed to the toilet 14. The toilet seat tilting device 10 further includes the install bracket 74 that fixes the base 16 to the toilet 14. The install bracket 74 has a thorough hole 76, through which a bolt (not shown) provided on the toilet passes through. The install bracket 74 is fixed to the base 16 with two bolts 78. In this way, the toilet seat tilting device 10 can be installed to the toilet 14 at either side of the toilet without modification of the toilet 14 and without need of fixing the device 10 to a floor around the toilet 14.

The length of the connecting rod 26 is adjustable. Referring to FIGS. 3 and 4, the connecting rod 26 includes a rod body 80 and two rod end pieces 82. Each of the rod end pieces 82 includes an end thread portion 84 that engages with a rod thread portion 86 that is provided on the rod body 80.

Referring to FIGS. 1, 2, 4 and 6, the toilet seat tilting device 10 further includes the support column 88 that is fixed to the base 16 and supports the seat tilting member 18. The length of the support column 88 is adjustable. The support column 88 includes a column body 90 and one or more column end piece 92. The column end piece 92 includes an end thread portion 94 that engages with a column thread portion 96 that is provided on the column body.

In this way, the toilet seat tilting device 10 can be installed at toilets 14 having various heights of the seat 12.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A toilet seat tilting device, wherein a seat of a toilet is tilted up or down by the toilet seat tilting device, the device comprising:

a) a base comprising a cam bracket and a lever bracket;

b) a seat tilting member;

c) a cam member pivotally attached to the cam bracket and comprising a cam pivot point, around which the cam member is pivoted, a first arm, and a second arm, wherein the first arm and the second arm are positioned opposite with respect to the cam pivot point;

d) a first lever pivotally attached to the lever bracket and comprising a first lever pivot point, around which the first lever is pivoted, a first pedal, and a first actuating arm, wherein the first pedal and the first actuating arm are positioned opposite with respect to the first lever pivot point;

e) a second lever pivotally attached to the lever bracket and comprising a second lever pivot point, around which the second lever is pivoted, a second pedal, and a second actuating arm, wherein the second pedal and the second actuating arm are positioned opposite with respect to the second lever pivot point; and f) a connecting rod connecting the cam member and the seat tilting member;

wherein when the first pedal is pressed the first actuating arm pivots the first arm of the cam member upward and the seat of the toilet is tilted upward until the seat is fully pivoted upward, and the seat remains fully pivoted upward; and wherein when the second pedal is pressed the second actuating arm pivots the second arm of the cam member upward and the seat of the toilet is tilted downward until the seat is fully pivoted downward, and the seat remains fully pivoted downward.

2. The toilet seat tilting device of claim 1, wherein the seat tilting member comprises a seat bracket, and a seat piece pivotally attached to the seat bracket, wherein the seat piece comprises a seat pivot point, around which the seat piece is pivoted, a first seat arm that is connected to the connecting rod, a second seat arm that supports the seat of the toilet, wherein the first seat arm and the second seat arm are positioned opposite with respect to the seat pivot point.

3. The toilet seat tilting device of claim 2, wherein the seat piece further comprises a seat holder attached to the second seat arm, wherein the seat holder comprises an upper holding member and a lower holding member, wherein the seat is supported between the upper holding member and the lower holding member.

4. The toilet seat tilting device of claim 3, wherein the upper holding member is a rod, and wherein the lower holding member is a plate.

5. The toilet seat tilting device of claim 4, wherein the upper holding member has a hold thread portion that engages with a seat thread portion that is provided in the second seat arm, whereby the distance between the upper holding member and the lower holding member is adjustable.

6. The toilet seat tilting device of claim 2, wherein the seat pivot point is positioned substantially to be the same line with the axis of hinges for the seat of the toilet.

7. The toilet seat tilting device of claim 2, wherein the connecting rod is pivotally attached to the second arm of the cam member and to the first seat arm of the seat tilting member.

8. The toilet seat tilting device of claim 1, wherein the first actuating arm of the first lever is made of wire and comprises a first lever body and a first end portion that is bent from the first lever body and contacts the first arm of the cam member, wherein the second actuating arm of the second lever is made of wire and comprises a second lever body and a second end portion that is bent from the second lever body and contacts the second arm of the cam member.

9. The toilet seat tilting device of claim 1, wherein the base is fixed to the toilet.

10. The toilet seat tilting device of claim 9, further comprising an install bracket that fixes the base to the toilet, wherein the install bracket comprises a thorough hole, through which a bolt provided on the toilet passes through.

11. The toilet seat tilting device of claim 1, wherein the length of the connecting rod is adjustable.

12. The toilet seat tilting device of claim 11, wherein the connecting rod comprises a rod body and one or more rod end piece, wherein the rod end piece comprises an end thread portion that engages with a rod thread portion that is provided on the rod body.

13. The toilet seat tilting device of claim 1, further comprising a support column that is fixed to the base and supports the seat tilting member.

14. The toilet seat tilting device of claim 13, wherein the length of the support column is adjustable.

15. The toilet seat tilting device of claim 14, wherein the support column comprises a column body and one or more column end piece, wherein the column end piece comprises an end thread portion that engages with a column thread portion that is provided on the column body.

* * * * *